US007770430B2

(12) United States Patent
Miceli et al.

(10) Patent No.: US 7,770,430 B2
(45) Date of Patent: Aug. 10, 2010

(54) SHELL PRESS, AND DIE ASSEMBLY AND ASSOCIATED METHOD THEREFOR

(75) Inventors: James Michael Miceli, Dayton, OH (US); Brent Allen Young, Huber Heights, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 12/207,653

(22) Filed: Sep. 10, 2008

(65) Prior Publication Data

US 2009/0078022 A1 Mar. 26, 2009

Related U.S. Application Data

(60) Provisional application No. 60/974,192, filed on Sep. 21, 2007.

(51) Int. Cl.
*B21J 13/02* (2006.01)
*B21D 37/04* (2006.01)

(52) U.S. Cl. ..... 72/478; 72/448; 72/481.3; 72/481.8; 100/918

(58) Field of Classification Search ..... 72/348, 72/481.8, 342.7, 478, 345, 351, 476, 462, 72/481.1, 481.3, 446, 448, 445, 473, 465.1, 72/342.8, 455, 482.92; 100/918, 324, 325, 100/137, 193
See application file for complete search history.

(56) References Cited

U.S. PATENT DOCUMENTS 4,166,372 A * 9/1979 Knight ..... 72/348
4,808,052 A 2/1989 Bulso, Jr. et al.
4,955,223 A 9/1990 Stodd et al.
4,977,772 A 12/1990 Bulso, Jr. et al.
5,042,284 A 8/1991 Stodd et al.
5,209,098 A 5/1993 Cudzik
5,331,836 A 7/1994 Cudzik
5,626,048 A 5/1997 McClung
5,628,224 A 5/1997 McClung et al.
5,715,721 A * 2/1998 Anders et al. ..... 72/311

(Continued)

OTHER PUBLICATIONS

The Minster Machine Company, Internet website pages (3), Aug. 21, 2008, http://www.minster.com.

(Continued)

*Primary Examiner*—Debra M Sullivan
(74) *Attorney, Agent, or Firm*—Eckert Seamans Cherin & Mellott, LLC; Grant E. Coffield, Esq.

(57) ABSTRACT

A die assembly is provided, which is structured to be affixed to a shell press. The die assembly includes at least one die shoe having first and second opposing ends, and a number of divisions between the first end and the second end. The divisions are structured to divide the at least one die shoe into a plurality of pieces to accommodate thermal expansion. Each of the divisions between the pieces of the at least one die shoe has a profile. Preferably, the profile is not straight. Each of the divisions of the at least one die shoe form a gap between the pieces of the die shoe, thereby spacing the pieces apart from one another. The pieces are independently coupled to a corresponding mounting surface of the shell press. A shell press and a method for employing the die assembly in a shell press are also disclosed.

12 Claims, 4 Drawing Sheets

U.S. PATENT DOCUMENTS

| | | | |
|---|---|---|---|
| 7,073,364 | B2 | 7/2006 | Krish, Sr. et al. |
| 7,143,623 | B1 | 12/2006 | Turnbull et al. |
| 7,302,822 | B1 | 12/2007 | Turnbull et al. |
| 7,305,861 | B2 | 12/2007 | Turner et al. |
| 2007/0166419 | A1 | 7/2007 | Tanaka et al. |

OTHER PUBLICATIONS

Written Opinion issued in International Application No. PCT/US2008/075795.

* cited by examiner

SHELL PRESS, AND DIE ASSEMBLY AND ASSOCIATED METHOD THEREFOR

CROSS-REFERENCE TO RELATED APPLICATION

This application claims the benefit of U.S. Provisional Patent Application Ser. No. 60/974,192, filed Sep. 21, 2007.

BACKGROUND OF THE INVENTION

1. Field of the Invention

The invention relates generally to presses and, more particularly, to shell presses and associated methods for forming container closures or ends, commonly referred to as shells. The invention also relates to die assemblies for shell presses.

2. Background Information

The forming of can ends or shells for can bodies, namely aluminum or steel cans, is generally well-known in the art.

There is an ongoing desire in the can-making industry to manufacture shells as rapidly and efficiently as possible. Among the ways companies have attempted to achieve these objectives are: (1) to increase the number of pockets in the die set, within which shells can be formed; and (2) to increase the speed (e.g., strokes per minute (spm)) at which the shell press operates. In general, with each stroke of the shell press ram, one shell is formed in each tooling pocket of the die assembly. Thus, a 24-out die assembly, for example, which has 24 tooling pockets, is capable of forming 24 shells, per stroke. U.S. Pat. No. 5,491,995, which is hereby incorporated herein by reference, discloses an example of a relatively high capacity (e.g., without limitation, operating speed of up to 400 spm, or more) end shell manufacturing system having a 24-out die assembly.

However, forming shells at relative high speeds generates heat. The heat, which is caused by the friction associated with drawing the metal over forming surfaces of the die assembly and/or clamping the metal between various pressure pads and drawing it through reduced tooling clearances to provide a desired shape, can be excessive, resulting in thermal expansion of the die shoes. Among other disadvantages, such thermal expansion undesirably shifts tooling and/or reduces critical clearances between cutting and/or forming tools. Consequently, tooling wear or damage can result and/or certain features of the end shells are manufactured out-of-specification. For example, thinned spots can be created in the material from which the end shell is manufactured, leading to a loss in buckle pressure performance in the final product.

The foregoing difficulties have been exacerbated by the development of new shell designs having aggressive material thicknesses and shapes. For example, some shells require reduced material thickness and/or have a relatively complex geometry. Such shapes often necessitate additional pressure pads and increased forming pressures in order to properly manufacture the end shells.

Prior proposals that attempted to address thermal expansion of the die assembly tooling (e.g., without limitation, upper and lower die shoes) involved aligning the upper tooling with respect to the lower tooling in the die assembly in a manner intended to compensate for the thermal expansion. Other proposals require coolant (e.g., chilled water) to be pumped throughout the die assembly, for example, to reduce the rate and amount of thermal expansion of the die shoes. However, estimating and establishing the proper aligning of the upper tooling with respect to the lower tooling is a time-consuming process, and it can be difficult to maintain the desired alignment. Similarly, systems that add coolant or other suitable additional cooling or heating mechanisms to the die assembly to compensate for thermal expansion, are costly to install and maintain.

There is, therefore, room for improvement in shell presses, and in die assemblies and associated methods therefor.

SUMMARY OF THE INVENTION

These needs and others are met by embodiments of the invention, which are directed to a die assembly and associated method for shell presses which, among other benefits, incorporates a die shoe that is divided (e.g., separated; split) into separate pieces to accommodate thermal expansion.

As one aspect of the invention, a die assembly is provided, which is structured to be affixed to a shell press. The die assembly comprises: at least one die shoe comprising a first end, a second end disposed opposite and distal from the first end, and a number of divisions between the first end and the second end. The divisions are structured to divide such die shoe into a plurality of pieces to accommodate thermal expansion.

Each of the divisions between the pieces of the at least one die shoe may have a profile, and the profile may not be straight. The at least one die shoe may further comprise a first edge and a second edge disposed opposite and distal from the first edge, and the profile may be a stepped profile. The stepped profile may include a first segment, a second segment and a third segment interconnecting the first segment and second segment, wherein the first segment extends from the first edge of the at least one die shoe toward the second edge of the at least one die shoe, and the second segment extends from the second edge of the at least one die shoe toward the first edge. The first segment may be offset from the second segment, and the third segment may extend perpendicularly between the first segment and the second segment.

The number of divisions of the at least one die shoe may be a first division and a second division, and the plurality of pieces of the at least one die shoe may be a first piece, a second piece and a third piece. The first division may be disposed between the first piece and the second piece, and the second division may be disposed between the second piece and the third piece.

The shell press may include a first mounting surface and a second mounting surface, and the at least one die shoe may further comprise a first side and a second side disposed opposite the first side. The first side may be structured to be coupled to a corresponding one of the first mounting surface of the shell press and the second mounting surface of the shell press, and the second side may include a number of tooling pockets structured to receive tooling. Each of the divisions of the at least one die shoe may form a gap between the pieces of the at least one die shoe, thereby spacing the pieces apart from one another, wherein the pieces are structured to be independently coupled to the corresponding one of the first mounting surface of the shell press and the second mounting surface of the shell press.

The at least one die shoe may be a first die shoe and a second die shoe. The pieces of the first die shoe may be structured to be coupled to the first mounting surface of the shell press, and the pieces of the second die shoe may be structured to be coupled to the second mounting surface of the shell press, opposite the first die shoe. The first die shoe may further comprise first tooling coupled to the second side of the first die shoe at or about the tooling pockets of the first die shoe, and the second die shoe may further comprise second tooling coupled to the second side of the second die shoe at or about the tooling pockets of the second die shoe. The first tooling may be disposed opposite the second tooling, wherein the first tooling and the second tooling are structured to cooperate upon actuation of the shell press to form a piece of material disposed therebetween.

The first die shoe may be coupled to the second die shoe by a plurality of guide assemblies. Each guide assembly may include a guide pin, a ball cage and a ball cage bushing. The guide pin may be coupled to the second side of a first one of the first die shoe and the second die shoe, the ball cage bushing may be coupled to the second side of the other of the first die shoe and the second die shoe, and wherein the ball cage may be disposed on the guide pin. When the first die shoe is coupled to the second die shoe, the guide pin and the ball cage may be structured to be at least partially disposed within the ball cage bushing.

As another aspect of the invention, a shell press comprises: a first mounting surface; a second mounting surface disposed opposite the first mounting surface; and a die assembly comprising: at least one die shoe comprising a first side, a second side disposed opposite the first side, a first end, a second end disposed opposite and distal from the first end, and a number of divisions between the first end and the second end, the first side being coupled to a corresponding one of the first mounting surface of the shell press and the second mounting surface of the shell press. The number of divisions divide such die shoe into a plurality of pieces to accommodate thermal expansion.

The at least one die shoe may be a first die shoe and a second die shoe, wherein each of the first die shoe and the second die shoe further comprise a first edge and a second edge disposed opposite and distal from the first edge. The die assembly may further comprise a first fixture plate, a second fixture plate, at least one loading rail and at least one strap. Prior to being affixed to the shell press, the first side of the first die shoe may be coupled to the first fixture plate, the first side of the second die shoe may be coupled to the second fixture plate, the at least one loading rail may be coupled to a corresponding one of the first edge of the second die shoe and the second edge of the second die shoe, and the at least one strap may couple one of the first edge of the first die shoe and the second edge of the first die shoe to a corresponding one of the first edge of the second die shoe and the second edge of the second die shoe.

As another aspect of the invention, a method is provided for employing a die assembly in a shell press. The method comprises: providing a number of divisions in at least one die shoe of the die assembly to divide the at least one die shoe into a plurality of pieces; and coupling each of the pieces of the at least one die shoe to a corresponding mounting surface of the shell press.

The die assembly may include a first die shoe and a second die shoe each having a plurality of pieces, and the method may further comprise coupling the pieces of the first die shoe to a first fixture plate, and coupling the pieces of the second die shoe to a second fixture plate. The method may further comprise: mounting first tooling to the first die shoe, and mounting second tooling to the second die shoe. The method may also comprise: positioning the first die shoe on top of the second die shoe, coupling the first die shoe to the second die shoe with at least one strap, and coupling at least one loading rail to the second die shoe. The method may further comprise: removing the second fixture plate from the second die shoe, and transporting the die assembly to the shell press. The first fixture plate may then be removed from the first die shoe, the pieces of the first die shoe may be fastened to the first mounting surface of the shell press, the pieces of the second die shoe may be fastened to the second mounting surface of the shell press, and the at least one strap and the at least one loading rail may be removed.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
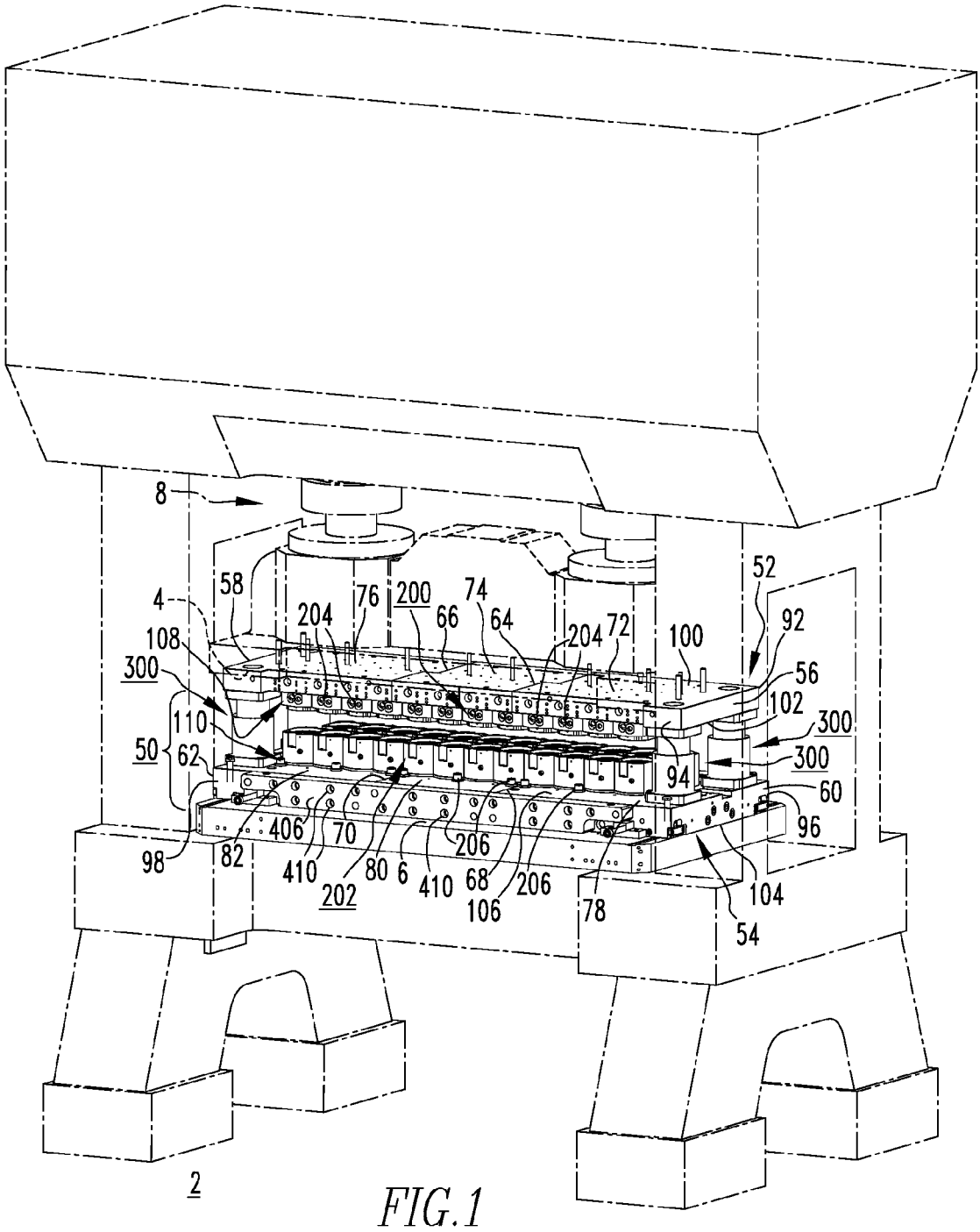
FIG. 1 is an isometric view of a shell press and die assembly therefor, in accordance with an embodiment of the invention, showing the shell press in simplified form in phantom line drawing.

For purposes of illustration, embodiments of the invention will be described as applied to die assemblies for a 24-out shell press system, although it will become apparent that they could also be applied to a wide variety of shell press systems having a die assembly with any known or suitable number and/or configuration of tooling pockets.

Directional phrases used herein such as, for example, upper, lower, top, bottom and derivatives thereof, relate to the orientation of the elements shown in the drawings and are not limiting upon the claims unless expressly recited therein.

As employed herein, the term "can" refers to any known or suitable container, which is structured to contain a substance (e.g., without limitation, liquid; food; any other suitable substance), and expressly includes, but is not limited to, beverage cans, such as beer and soda cans, as well as food cans.

As employed herein, the term "can end" refers to the closure that is structured to be coupled to a can, in order to seal the can.

As employed herein, the terms "shell" and "can end shell" refers to the member that is formed by the disclosed shell press and is subsequently acted upon and converted by a suitable tooling assembly within a conversion press in order to provide the desired can end.

As employed herein, the term "fastener" refers to any suitable connecting or tightening mechanism expressly including, but not limited to, rivets, pins, rods, clamps and clamping mechanisms, screws, bolts (e.g., without limitation, carriage bolts) and the combinations of bolts and nuts (e.g., without limitation, lock nuts and wing nuts) and bolts, washers and nuts.

As employed herein, the term "division" refers to any known or suitable mechanism for separating one component from another component expressly including, but not limited to, a space or a gap.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a shell press 2 (shown in simplified form in phantom line drawing in FIG. 1) employing a die assembly 50 in accordance with the invention. Presses, such as the press 2 to which the die assembly 50 is affixed in the example of FIG. 1, are generally well known in the art. One non-limiting example is a Minster shell press, which is available from the Minster Machine Company, located in Minster, Ohio. The shell press 2 includes a first or upper (e.g., from the perspective of FIG. 1) mounting surface 4, a second or lower (e.g., from the perspective of FIG. 1) mounting surface 6, commonly referred to as the press bed, and a press ram (generally indicated by reference numeral 8 in FIG. 1). It will be appreciated that while the shell press 2 shown in the example of FIG. 1 is a single-action press, wherein upon actuation of the press ram 8, the first mounting surface 4 is moved toward the opposing second mounting surface 6, that any known or suitable alternative press type and/or configuration (not shown) such as, for example and without limitation, a double-action press (not shown), could be employed without departing from the scope of the invention.

Figure 2:
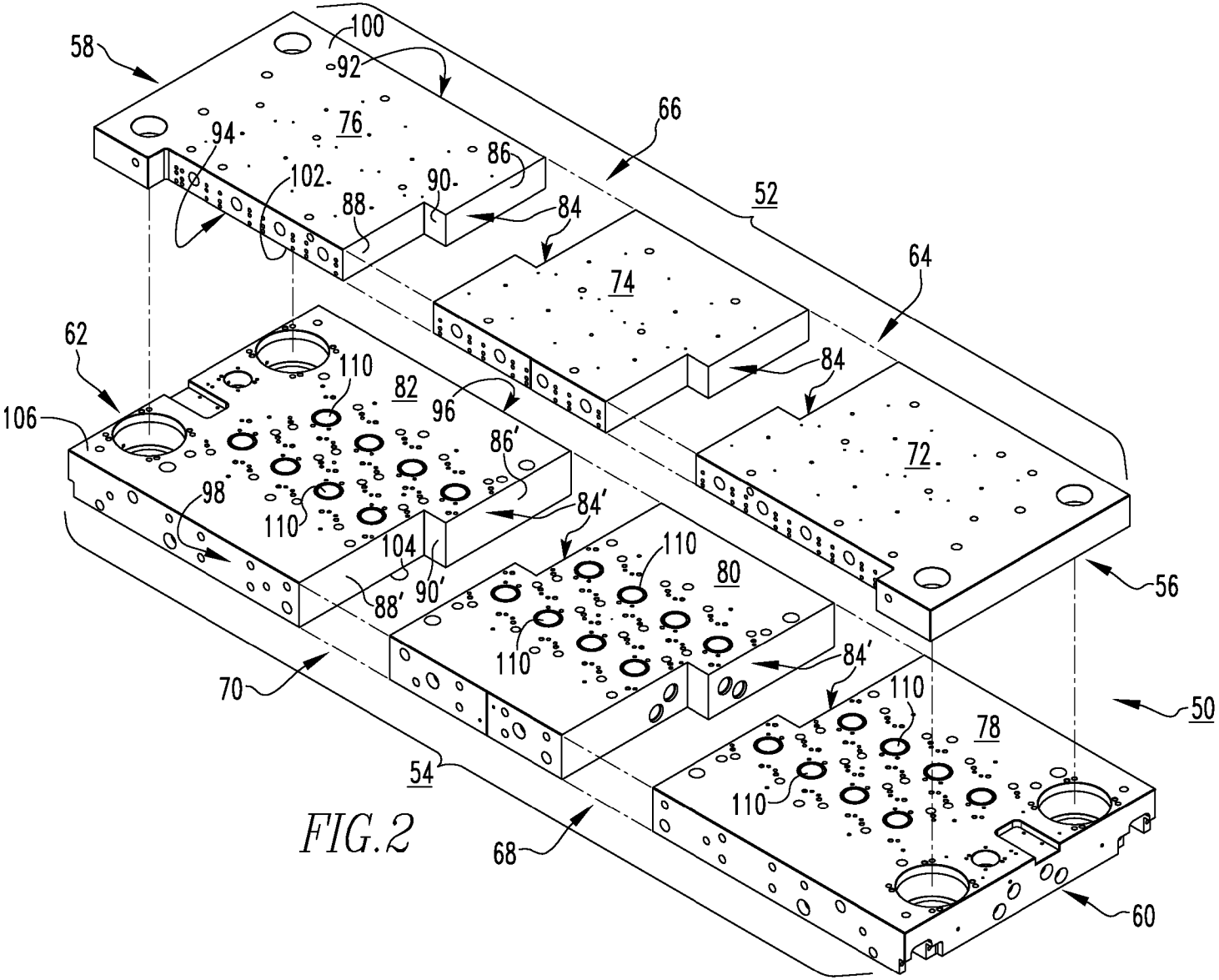
FIG. 2 is an exploded isometric view of the first and second die shoes of the die assembly of FIG. 1.
Figure 3A:
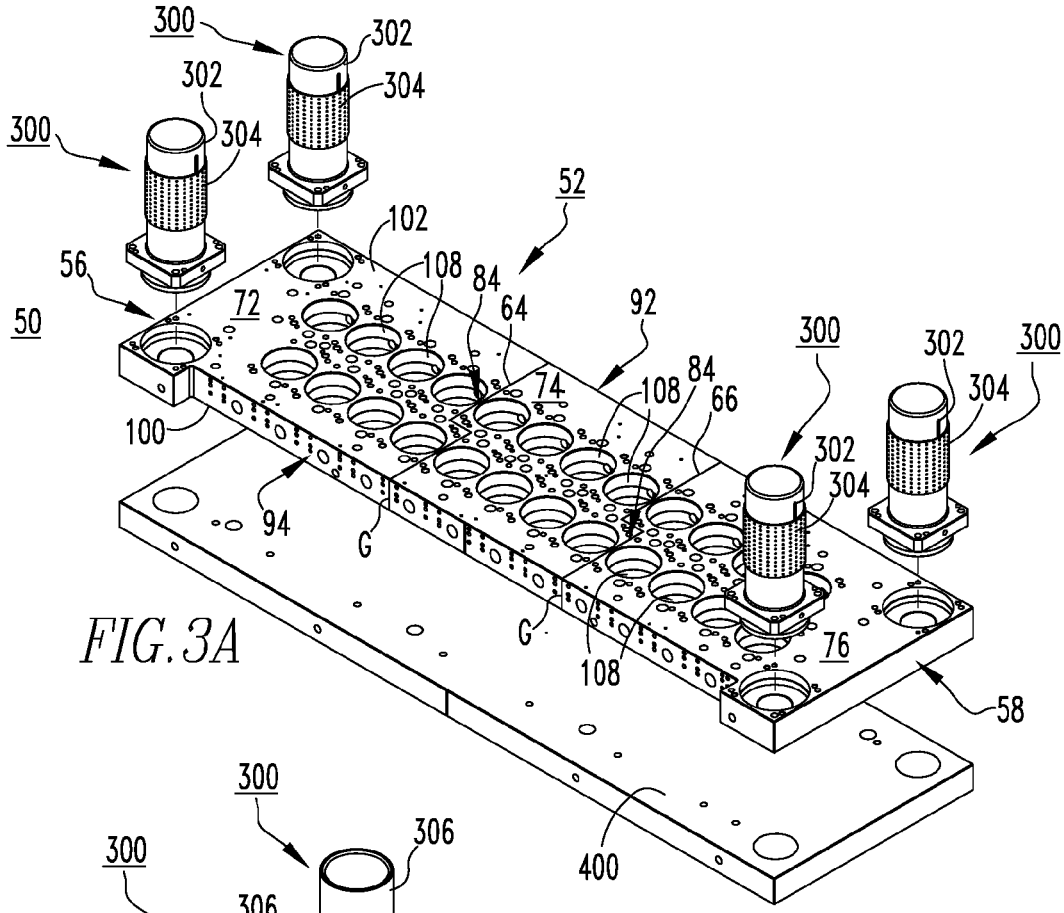
FIG. 3A is an assembled isometric view of the first die shoe of FIG. 2, also showing a first fixture plate and portions of guide assemblies for the die shoes.
Figure 3B:
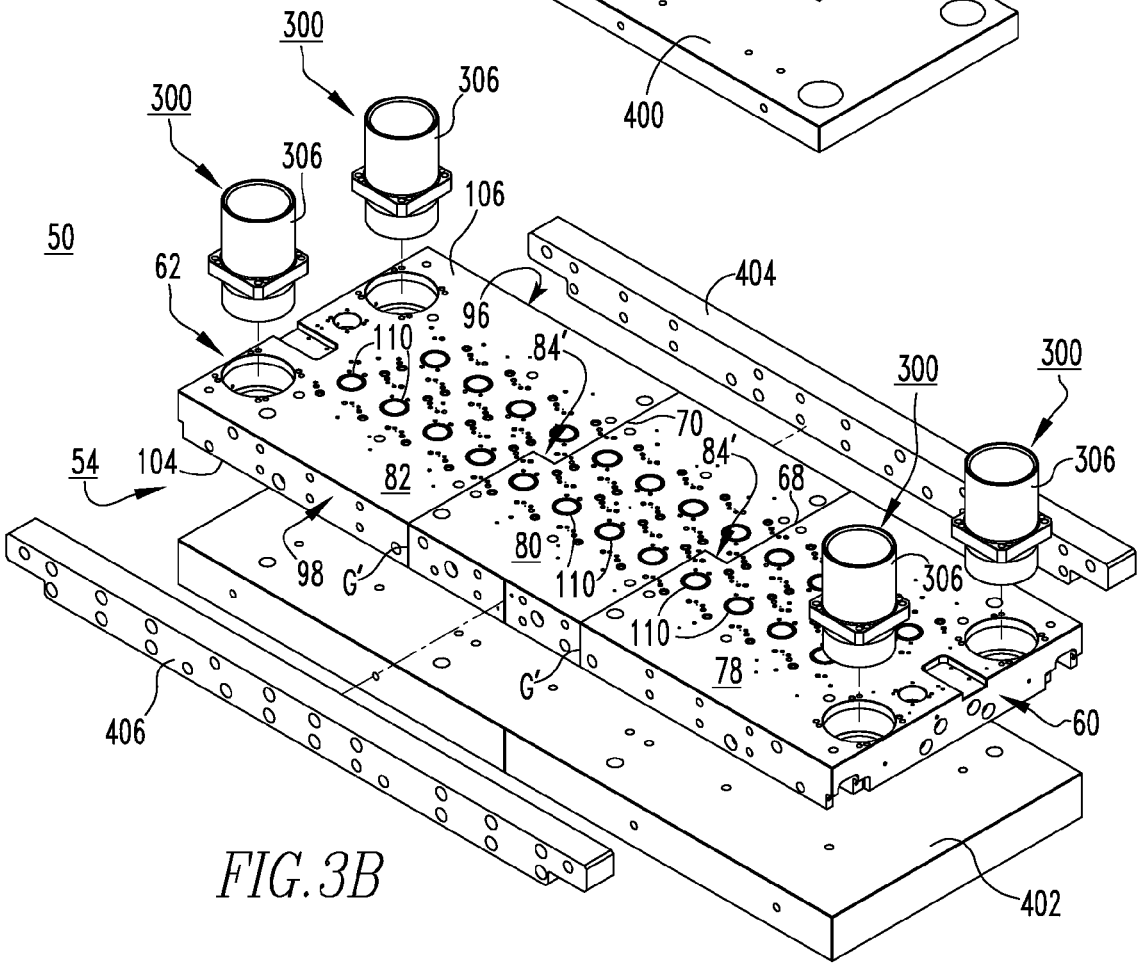
FIG. 3B is an assembled isometric view of the second die shoe of FIG. 2, also showing a second fixture plate, loading rails and the other portions of the guide assemblies.

Continuing to refer to FIG. 1, and also to FIGS. 2, 3A and 3B, the die assembly 50 includes first and second die shoes 52,54. The first or upper (e.g., from the perspective of FIGS. 1 and 2) die shoe 52 includes first and second opposing ends 56,58 and a number of divisions 64,66, which divide the first die shoe 52 into a plurality of pieces 72,74,76. As will be discussed hereinbelow, the divisions 64,66 are structured to accommodate thermal expansion of the first die shoe 52 resulting from relatively high speed operation of the shell press 2 (FIG. 1). Similarly, the second die shoe 54, which is disposed opposite and spaced from the first die shoe 52, includes first and second opposing ends 60,62 and a number of divisions 68,70 therebetween. As best shown in the exploded view of FIG. 2, the example first and second die shoes 52 and 54 include two divisions 64,66 and 68,70, respectively, thereby dividing each of the first and second die shoes 52 and 54 into three pieces 72,74,76 and 78,80,82, respectively. However, any known or suitable alternative number and/or configuration of divisions (not shown) could be employed to divide either or both of the die shoes 52,54 into any known or suitable alternative number and/or configuration of pieces to accommodate thermal expansion within the scope of the invention.

Each of the divisions 64,66 of the example first die shoe 52 has a profile 84. Preferably, the profile 84 is not straight. Specifically, in the example of FIG. 2, the division profile 84 is a stepped profile having first, second and third segments 86,88,90. The first segment 86 extends inwardly from a first edge 92 of the first die shoe 52, the second segment 88 extends inwardly from an opposing second edge 94 of the first die shoe 52, and the third segment 90 extends perpendicularly between the first and second segments 86,88 to create a step therebetween, as shown. In other words, the first segment 86 is offset with respect to the second segment 88. As shown in FIG. 2, the example second die shoe 54 includes divisions 68,70 having a substantially similar stepped profile 84' with first, second and third segments 86',88',90'. It will, however, be appreciated that the second or lower (e.g., from the perspective of FIG. 2) die shoe 54 need not necessarily have the same number and/or configuration of divisions (e.g., 68,70) or profiles (e.g., 84') therefor. The profiles 84,84' of the first and second die shoes 52,54 of the example die assembly 50 are also shown in FIGS. 3A and 3B, respectively. It will be appreciated that, among other benefits, the stepped nature of such division profiles 84,84' facilitates establishing and maintaining proper orientation and alignment between the pieces 72,74,76 and 78,80,82 of the die shoes 52 and 54, respectively.

Figure 4A:
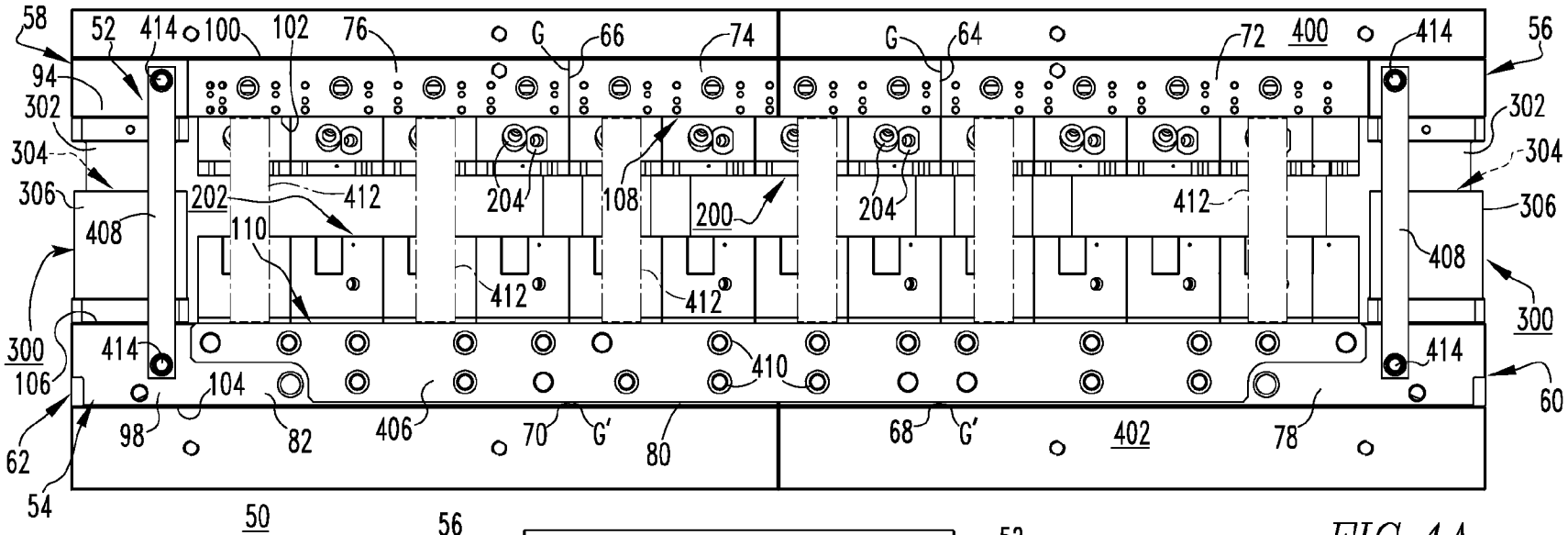
FIGS. 4A and 4B are side elevation and end elevation views, respectively, of the die assembly prior to being inserted into and secured within the shell press.
Figure 4B:
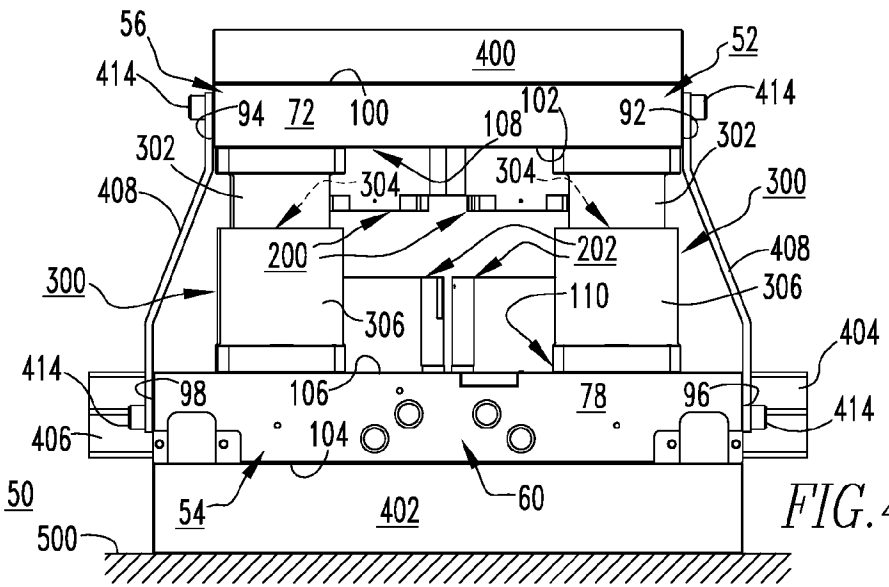

The first die shoe 52 also includes a first side 100, which is structured to be coupled to the first mounting surface 4 of the shell press 2, in a generally well known manner, as illustrated in FIG. 1. The second side 102 of the first die shoe 52 includes a number of tooling pockets 108 (best shown in FIG. 3A), which are structured to receive first tooling 200 (described hereinbelow), as shown in FIGS. 1, 4A and 4B. The second or lower (e.g., from the perspective of FIG. 1) die shoe 54 is coupled to the second mounting surface 6 (e.g., without limitation, press bed; bolster plate) of the shell press 2 in a similarly well known manner. That is, a first side 104 of the second die shoe 54 is coupled to the second mounting surface 6, as illustrated in FIG. 1, and the opposing second side 106 of the second die shoe 54 includes a number of tooling pockets 110 (best shown in FIG. 3B) structured to receive second tooling 202 (FIGS. 1, 4A and 4B) in an opposing relationship to the first tooling 200 of FIGS. 1, 4A and 4B. In one non-limiting embodiment, which is shown herein for purposes of illustration only and is not limiting upon the scope of the invention in any way, the upper and lower die shoes 52,54 include 24 tooling pockets 108,110 (best shown in FIGS. 3A and 3B), respectively. More precisely, the first and second tooling 200, 202, which is affixed to the tooling pockets 108,110 of the first and second die shoes 52,54, respectively, cooperate to provide the example die assembly 50 with 24 tooling pockets. Thus, it will be appreciated that the die assembly 50 shown and described herein is a 24-out system, wherein with each stroke of the press ram 8 (FIG. 1) the first and second tooling 200,202 cooperates to form a piece of material (not shown) disposed therebetween into 24 separate shells (not shown).

As previously noted, conventional die assemblies include one-piece die shoes (not shown), wherein the entire die shoe is made from a single continuous piece of material (e.g., without limitation carbon steel), without any divisions therein. When the press (see, for example, shell press 2 of FIG. 1) is operated at relatively high speeds, heat is generated by the tooling as it forms the material into the desired end shell (not shown). Such heat is transferred to the die shoe(s) and undesirably causes thermal expansion thereof. As discussed hereinabove, such thermal expansion is disadvantageous because, among other problems, it undesirably reduces critical tooling clearances and/or shifts the tooling such that at least some of the end shell products are manufactured outside of specification (e.g., acceptable dimensions). The divisions 64,66,68,70 of the first and/or second die shoes 52,54 of the disclosed die assembly 50 are structured to address and overcome the foregoing disadvantages. Specifically, as shown in FIG. 3A, the divisions 64,66 of the first die shoe 52 form gaps, G, between the pieces 72,74,76 of the first die shoe 52, thereby spacing the pieces 72,74,76 apart from one another. The pieces 72,74,76 are then independently coupled to the first mounting surface 4 (FIG. 1) of the shell press 2 (FIG. 1) using fasteners (partially shown in FIG. 1) in a generally well known manner. Thus, the pieces 72,74,76 of the first die shoe 52 are effectively decoupled from one another. Consequently, the divisions 64,66 and gaps, G, provided thereby, provide discontinuity on resistance in the form of a barrier to heat transfer from one piece 72,74,76 among the pieces 72,74,76 of the die shoe 52. As such, thermal expansion of the multi-piece die shoe 52 of the disclosed die assembly 50 substantially reduces undesirable thermal expansion compared to conventional one-piece die shoe designs (not shown).

As shown in the example of FIG. 3B, the second or lower die shoe 54 of the example die assembly 50 also includes two gaps, G', formed by the divisions 68,70 of the second die shoe 54. Such gaps, G', function substantially similarly to gaps, G, previously discussed hereinabove with respect to FIG. 3A, to effectively substantially reduce undesirable thermal expansion of the lower die shoe 54. In one non-limiting embodiment of the invention, the gaps, G (FIG. 3A), G' (FIG. 3B), formed by the divisions 64,66 (FIG. 3A), 68,70 (FIG. 3B) of the die shoes 52 (FIG. 3A), 54 (FIG. 3B), respectively, space the pieces 72,74,76 (FIG. 3A), 78,80,82 (FIG. 3B) of the die shoes 52 (FIG. 3A), 54 (FIG. 3B), respectively, apart from one another a distance of about 0.01 inch to about 0.06 inch. It will, however, be appreciated that other gap dimensions could be employed without departing from the scope of the invention. Preferably, the separation provided by the gaps (e.g., G,G') will not be less than the amount of calculated thermal expansion of the corresponding die shoe 52,54. In this manner, it can be assured that the pieces (see, for example, pieces 72,74,76 of first die shoe 52 of FIG. 3A) do not thermally expand so much as to contact one another.

Accordingly, the disclosed die assembly 50 and, in particular, the multi-piece die shoe design thereof, provides a robust solution to thermal expansion and substantially overcomes the disadvantages (e.g., without limitation, manufactured product being out of specification; reduced critical tooling clearance resulting in thinned material; premature tooling wear) associated therewith. In particular, the disclosed die assembly 50 is robust in that it eliminates the requirement for costly and maintenance-intensive cooling and/or heating devices previously used by known shell systems to, for example, provide coolant (e.g., without limitation, chilled water) to compensate for thermal expansion. In doing so, the disclosed die assembly 50 also overcomes another disadvantage associated with such systems. For example, coating caused by the coolant or other suitable fluid used in such systems is not present and, therefore, does not undesirably build-up on critical tooling components and adversely affect end shell product quality.

Continuing to refer to FIGS. 3A and 3B, the example die assembly 50 further includes a plurality of guide assemblies 300 (partially shown in FIGS. 3A and 3B; see also FIGS. 1, 4A and 4B), which couple the first and second die shoes 52,54 together, as shown in FIGS. 1, 4A and 4B. Each guide assembly 300 includes a guide pin 302 and a ball cage 304, which is disposed on the guide pin 302, as shown in FIG. 3A, and a ball cage bushing 306 shown in FIG. 3B. The guide pin 302 is coupled to the second side 102 of the first die shoe 52, as shown in FIG. 3A, and the ball cage bushing 306 is coupled to the second side 106 of the second die shoe 54, as shown in FIG. 3B. When the first die shoe 52 is coupled to the second die shoe 54, as shown in FIGS. 1, 4A and 4B, the guide pin 302 and the ball cage 304 are at least partially disposed within the ball cage busing 306. In this manner, the guide assembly 300 provide an effective mechanism for establishing and/or maintaining the desired alignment and motion between the first and second die shoes 52,54. The example die assembly 50 includes four guide assemblies 300, one extending between each of the opposing corners of the die shoes 52,54. It will, however, be appreciated that any known or suitable alternative guide mechanism (not shown) could be employed in any known or suitable alternative number and/or configuration (not shown), without departing from the scope of the invention.

Prior to being affixed to the shell press 2, as shown in FIG. 1, the first and second die shoes 52,54 are coupled to first and second fixture plates 400,402 (both shown in FIGS. 4A and 4B), respectively, using a number of suitable fasteners (not shown), as defined herein. Among other functions, the fixture plates for 400,402 function to provide a platform on which the die shoes 52,54 can be machined, assembled and/or secured when being moved prior to being fastened to the shell press 2 (FIG. 1). It will, however, be appreciated that any known or suitable alternative mechanism or structure (not shown) could be employed to secure the pieces 72,74,76 and 78,80,82 of the first and second die shoes 52 and 54, respectively, together at least temporarily to machine, assemble and/or transport them.

In addition to the fixture plates 400 (FIGS. 3A, 4A and 4B), 402 (FIGS. 3B, 4A and 4B), the example die assembly 50 further includes at least one loading rail (two loading rails 404,406 are shown in FIGS. 3B and 4B; see also loading rail 406 in FIGS. 1 and 4A). In the example of FIGS. 3B and 4B, a first loading rail 404 coupled to the first edge 96 of the second die shoe 54 and a second loading rail 406 coupled to the opposing second edge 98 of the second die shoe 54. Any known or suitable number, type and/or configuration of fasteners (see, for example, fasteners 410 in FIG. 4A), as defined herein, can be employed to suitably fasten the loading rails 404,406 to the corresponding edges 96,98, respectively, of the second die shoe 54. As shown in FIGS. 4A and 4B, the example die assembly 50 also includes a plurality of straps 408, which at least temporarily couple the first edges 92,96 of the first and second die shoes 52,54 and the second edges 94,98 of the first and second die shoes 52,54, respectively, using any known or suitable number, type and/or configuration of fastener(s) (see, for example, fasteners 414 of FIGS. 4A and 4B).

A method of employing the die assembly 50 in a shell press (see, for example, shell press 2 of FIG. 1) in accordance with one non-limiting embodiment of the invention will now be described in greater detail. Specifically, the general steps of the method in accordance with the invention are: (1) to provide a number of divisions 64,66,68,70 in at least one die shoe 52,54 of the die assembly 50 to divide such die shoe(s) 52,54 into a plurality of pieces 72,74,76,78,80,82, as previously discussed; and (2) to couple each of the pieces 72,74,76,78,80,82 of the die shoe(s) 52,54 to the corresponding mounting surface 4,6 (FIG. 1) of the shell press 2 (FIG. 1). However, prior to fixing the die assembly 50 to the shell press 2 (FIG. 1) for use therein, the die assembly 50 must be assembled and prepared for transport to, and into, the press 2 (FIG. 1). Typically, this is accomplished by positioning the die assembly 50 on a suitable surface, such as for example and without limitation, a granite surface plate 500 (partially shown in simplified form in FIG. 4B). Specifically, the first fixture plate 400 and first die shoe 52 coupled thereto and the second fixture plate 402 and second die shoe 54 coupled thereto are placed on the surface 500 (FIG. 4B) as sub-assemblies, which are to be further assembled and subsequently coupled together, as described hereinbelow.

The first and second tooling 200,202 (FIGS. 1, 4A and 4B) is then coupled to the first and second die shoes 52,54, respectively, as previously discussed, using any known or suitable number, type and/or configuration of fastener(s) (see, for example, fasteners 204 (FIG. 1),206 (FIGS. 1 and 4A)). The constituent parts of the aforementioned guide assemblies 300 are also assembled to their respective die shoes 52,54, and the first and second loading rails 404,406 are coupled to the opposing edges 96,98, respectively, of the second die shoe 54. The die shoes 52,54 are now ready to be assembled, one on top of the other as shown in FIGS. 4A and 4B. Preferably, this involves positioning a number of spacers 412, commonly referred to as tramming height gages or gage blocks, on top of the second side 106 of the second die shoe 54. The upper die shoe sub-assembly, which consists of the first fixture plate 400, first die shoe 54, first tooling 200 and guide assemblies 300, is lowered on top of the second die shoe 54 until the guide pins 302 and ball cages 304 of the portion of the guide assemblies 300 on the first die shoe 52 are inserted into the ball cage bushings 306 of the corresponding portion of the guide assemblies 300 on lower die shoe 54, and the upper die shoe 52 comes into contact with the tramming height gage blocks 412, as shown in FIG. 4A. The aforementioned straps 408 are then secured to the first edges 92,96 (FIG. 4B) and second edges 94,98 of the die shoes 52,54, respectively, by fasteners 414.

With the die assembly 50 and, in particular, the first and second die shoes 52,54 thereof, securely coupled together, the die assembly 50 can now be transported. However, prior to installing the die assembly 50 into the shell press 2, as shown in FIG. 1, the first and second fixture plates 400,402 must be removed from the first and second die shoes 52,54, respectively. Thus, the die assembly 50 is first lifted from surface 500 (FIG. 4B) so that the second or lower (from the perspective of FIG. 4B) fixture plate 402 can be removed from the first side 104 of the second die shoe 54. Once the second fixture plate 402 has been removed (see, for example, FIG. 1), the loading rails 404,406 continue to hold the pieces 78,80,82 (all shown in FIGS. 1, 2, 3A and 3B; partially shown in FIG. 4A; only piece 78 is shown in FIG. 4B) of the second die shoe 54 together. The die assembly 50 may now be placed on a suitable transport mechanism (e.g., without limitation, a rail system (not shown)) to be loaded into the press 2 (FIG. 1) between the first and second mounting surfaces 4,6 (FIG. 1) thereof. With the die assembly 50 resting on the transport mechanism (not shown), the first or upper (e.g., from the perspective of FIGS. 4A and 4B) fixture plate 400 is removed, prior to inserting the die assembly 50 into the press 2, as shown in FIG. 1. Once the die assembly 50 is positioned as desired within the shell press 2, the first and second die shoes 52,54 are fastened to the first and second mounting surfaces 4,6, respectively, using any known or suitable number, type and/or configuration of fasteners, in a generally well known manner. Finally, after the die assembly 50 is securely fastened within the press 2, the straps 408 (FIGS. 3B, 4A and 4B), loading rails 404,406 (both shown in FIGS. 3B and 4B), and tramming height gage blocks 412 (FIG. 4A) can be removed, and the shell press 2 is ready to be operated.

Accordingly, a die assembly 50 and associated method are disclosed, which enable efficient and effective operation of a shell press 2 at relatively high operating speeds (e.g., without limitation, up to about 400 stokes per minute, or more) while effectively accommodating heat that is commonly generated by such operating techniques. The die assembly 50 is also robust, thereby eliminating the need for expensive and maintenance-intensive cooling and/or heating systems, for example, yet effectively accommodating thermal expansion of the die assembly 50 and, in particular, of the die shoes 52,54. Consequently, end shells are consistently produced within the desired product specifications.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A die assembly structured to be affixed to a shell press, the die assembly comprising:

at least one die shoe comprising a first end, a second end disposed opposite and distal from the first end, and a number of divisions between the first end and the second end, wherein the number of divisions are structured to divide the at least one die shoe into a plurality of pieces to accommodate thermal expansion, wherein the shell press includes a first mounting surface and a second mounting surface; wherein the at least one die shoe further comprises a first side and a second side disposed opposite the first side; wherein the first side is structured to be coupled to a corresponding one of the first mounting surface of the shell press and the second mounting surface of the shell press; and wherein the second side includes a number of tooling pockets structured to receive tooling, wherein each of the divisions of the at least one die shoe forms a gap between the pieces of the at least one die shoe, thereby spacing the pieces apart from one another; and wherein the pieces are structured to be independently coupled to the corresponding one of the first mounting surface of the shell press and the second mounting surface of the shell press, wherein the at least one die shoe is a first die shoe and a second die shoe; wherein the pieces of the first die shoe are structured to be coupled to the first mounting surface of the shell press; and wherein the pieces of the second die shoe are structured to be coupled to the second mounting surface of the shell press, opposite the first die shoe, and wherein the first die shoe is coupled to the second die shoe by a plurality of guide assemblies; wherein each guide assembly includes a guide pin, a ball cage and a ball cage bushing; wherein the guide pin is coupled to the second side of a corresponding one of the first die shoe and the second die shoe; wherein the ball cage bushing is coupled to the second side of the other of the first die shoe and the second die shoe; wherein the ball cage is disposed on the guide pin;

and wherein, when the first die shoe is coupled to the second die shoe, the guide pin and the ball cage are structured to be at least partially disposed within the ball cage bushing.

2. The die assembly of claim 1 wherein each of the divisions between the pieces of the at least one die shoe has a profile with respect to the pieces; and wherein the profile is not straight.

3. The die assembly of claim 2 wherein the at least one die shoe further comprises a first edge and a second edge disposed opposite and distal from the first edge;

wherein the profile is a stepped profile; wherein the stepped profile includes a first segment, a second segment and a third segment interconnecting the first segment and second segment;

wherein the first segment extends from the first edge of the at least one die shoe toward the second edge of the at least one die shoe; wherein the second segment extends from the second edge of the at least one die shoe toward the first edge; wherein the first segment is offset from the second segment; and wherein the third segment extends perpendicularly between the first segment and the second segment.

4. The die assembly of claim 1 wherein the number of divisions of the at least one die shoe are a first division and a second division; wherein the plurality of pieces of the at least one die shoe are a first piece, a second piece and a third piece; wherein the first division is disposed between the first piece and the second piece; and wherein the second division is disposed between the second piece and the third piece.

5. The die assembly of claim 1 wherein the first die shoe further comprises first tooling coupled to the second side of the first die shoe at or about the tooling pockets of the first die shoe; wherein the second die shoe further comprises second tooling coupled to the second side of the second die shoe at or about the tooling pockets of the second die shoe; wherein the first tooling is disposed opposite the second tooling; and wherein the first tooling and the second tooling are structured to cooperate upon actuation of the shell press to form a piece of material disposed therebetween.

6. The die assembly of claim 1 wherein the gaps between the pieces of the at least one die shoe space the pieces of the at least one die shoe apart from one another a distance of about 0.01 inch to about 0.06 inch.

7. A shell press, die assembly and loading assembly in combination, the shell press comprising:

a first mounting surface;

a second mounting surface disposed opposite the first mounting surface; and a die assembly comprising:

at least one die shoe comprising a first side, a second side disposed opposite the first side, a first end, a second end disposed opposite and distal from the first end, and a number of divisions between the first end and the second end, the first side being coupled to a corresponding one of the first mounting surface of the shell press and the second mounting surface of the shell press, wherein the number of divisions divide the at least one die shoe into a plurality of pieces to accommodate thermal expansion, wherein each of the divisions of the at least one die shoe forms a gap between the pieces of the at least one die shoe such that the pieces of the at least one die shoe are spaced apart from one another; and wherein the pieces of the at least one die shoe are independently coupled to the corresponding one of the first mounting surface of the shell press and the second mounting surface of the shell press, and wherein the at least one die shoe is a first die shoe and a second die shoe;

wherein each of the first die shoe and the second die shoe further comprise a first edge and a second edge disposed opposite and distal from the first edge; and the loading assembly comprising of a first fixture plate, a second fixture plate, at least one loading rail and at least one strap; and wherein, prior to being affixed to the shell press, the first side of the first die shoe is coupled to the first fixture plate, the first side of the second die shoe is coupled to the second fixture plate, the at least one loading rail is coupled to a corresponding one of the first edge of the second die shoe and the second edge of the second die shoe, and the at least one strap couples one of the first edge of the first die shoe and the second edge of the first die shoe to a corresponding one of the first edge of the second die shoe and the second edge of the second die shoe.

8. The combination assembly of claim 7 wherein the gaps between the pieces of the at least one die shoe space the pieces of the at least one die shoe apart from one another a distance of about 0.01 inch to about 0.06 inch.

9. A method of employing a die assembly in a shell press, the method comprising:

providing a number of divisions in at least one die shoe of the die assembly to divide the at least one die shoe into a plurality of pieces, the die shoe being an elongated planar member;

independently coupling each of the pieces of the at least one die shoe to a corresponding mounting surface of the shell press, such that the at least one die shoe extends laterally, parallel with respect to the corresponding mounting surface;

the die assembly including as the at least one die shoe, a first die shoe and a second die shoe each having the plurality of pieces;

prior to coupling each of the pieces of the first die shoe to the corresponding mounting surface of the shell press, coupling the pieces of the first die shoe to a first fixture plate, and prior to coupling each of the pieces of the second die shoe to the corresponding mounting surface of the shell press, coupling the pieces of the second die shoe to a second fixture plate, coupling at least one loading rail to the second die shoe, positioning the first die shoe on top of the second die shoe, and coupling the first die shoe to the second die shoe with at least one strap.

10. The method of claim 9, further comprising:

following the steps of coupling the pieces of the first die shoe to the first fixture plate and coupling the pieces of the second die shoe to the second fixture plate and prior to the step of coupling the at least one loading rail to the second die shoe mounting a first tooling to the first die shoe, and mounting a second tooling to the second die shoe.

11. The method of claim 9, further comprising:

removing the second fixture plate from the second die shoe, and transporting the die assembly to the shell press.

12. The method of claim 11, further comprising:

removing the first fixture plate from the first die shoe, fastening the pieces of the first die shoe to the first mounting surface of the shell press, fastening the pieces of the second die shoe to the second mounting surface of the shell press, and removing the at least one strap and the at least one loading rail.

* * * * *

UNITED STATES PATENT AND TRADEMARK OFFICE
Certificate

Patent No. 7,770,430 B2 Patented: August 10, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: James Michael Miceli, Dayton, OH (US); Brent Allen Young, Huber Heights, OH (US); and Gregory H. Butcher, Columbus, OH (US).

Signed and Sealed this Eighteenth Day of June 2013.

DANA ROSS
*Supervisory Patent Examiner*
Art Unit 3725
Technology Center 3700